US011765511B2

(12) United States Patent
Tao et al.

(10) Patent No.: US 11,765,511 B2
(45) Date of Patent: Sep. 19, 2023

(54) SPEAKER

(71) Applicant: AAC Microtech (Changzhou) Co., Ltd., Changzhou (CN)

(72) Inventors: Weiwei Tao, Shenzhen (CN); Xin Jin, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 17/535,509

(22) Filed: Nov. 24, 2021

(65) Prior Publication Data

US 2022/0191617 A1 Jun. 16, 2022

(30) Foreign Application Priority Data

Dec. 16, 2020 (CN) ..... 202023045189.6

(51) Int. Cl.

| | |
|---|---|
| ***H04R 9/02*** | (2006.01) |
| ***H04R 9/06*** | (2006.01) |
| ***H04R 31/00*** | (2006.01) |
| ***H04R 9/04*** | (2006.01) |

(52) U.S. Cl.

CPC ..... *H04R 9/025* (2013.01); *H04R 9/045* (2013.01); *H04R 9/06* (2013.01); *H04R 31/006* (2013.01)

(58) Field of Classification Search

CPC ..... H04R 9/025; H04R 9/045; H04R 9/06; H04R 31/006; H04R 7/06; H04R 2307/207; H04R 2499/11; H04R 2231/003; H04R 3/00; H04R 1/06; H04R 1/1025; H04R 11/04; H04R 2400/03; H04R 2400/07; H02J 50/005; H02J 50/10; H02J 7/0042

USPC ..... 381/409, 424, 395, 396, 388, 333, 386

See application file for complete search history.

(56) References Cited

U.S. PATENT DOCUMENTS

| | | | | |
|---|---|---|---|---|
| 2012/0152648 | A1* | 6/2012 | Hiwatashi | H04R 1/06 181/148 |
| 2018/0270555 | A1* | 9/2018 | Mao | H04R 1/023 |
| 2018/0302722 | A1* | 10/2018 | Linghu | H04R 9/025 |
| 2018/0302723 | A1* | 10/2018 | Xiao | H04R 7/10 |

* cited by examiner

*Primary Examiner* — Carolyn R Edwards
*Assistant Examiner* — Julie X Dang
(74) *Attorney, Agent, or Firm* — W&G Law Group

(57) ABSTRACT

Provided is a speaker, including: a connector and a magnetic circuit unit and a vibration system that are fixed to the connector. The vibration system includes a first diaphragm fixed to the connector and a voice coil driving the first diaphragm to vibrate and sound. The magnetic circuit unit includes a magnet assembly providing driving force to the voice coil and a mounting member fixing the magnet assembly. A bending portion is formed by bending from an edge of the mounting member toward the first diaphragm, and the bending portion is fixedly connected to the connector. With this structure, the first diaphragm is fixedly connected to the mounting member, so as to strengthen the overall strength of the speaker and prevent the deformation of the speaker in its vibrating direction, thereby improving the quality of the speaker.

8 Claims, 4 Drawing Sheets

SPEAKER

TECHNICAL FIELD

The present disclosure relates to the field of acoustic technologies, and in particular, to a speaker.

BACKGROUND

A speaker is a transducer that converts electrical signals into sound signals. The speaker plays an indispensable role in audio devices.

In the related art, the speaker generally includes a magnetic circuit unit and a vibration system movable relative to the magnetic circuit unit. Upper shells and lower shells of most speakers are not fixedly connected. As a result, the vibration system is prone to deformation in its vibrating direction, thereby affecting the sound quality of the speaker.

SUMMARY

In view of the above, there is a need to provide a speaker not prone to deformation in its vibrating direction during vibration.

A speaker is provided, including: a connector and a magnetic circuit unit and a vibration system that are fixed to the connector. The vibration system includes a first diaphragm fixed to the connector and a voice coil driving the first diaphragm to vibrate and sound. The magnetic circuit unit includes a magnet assembly providing a driving force to the voice coil and a mounting member fixing the magnet assembly. A bending portion is formed by bending from an edge of the mounting member toward the first diaphragm, and the bending portion is fixedly connected to the connector.

With the speaker provided above, the magnet assembly is fixed to the mounting member, the magnet assembly provides the voice coil with driving force, the voice coil vibrates back and forth under the action of the driving force, and the voice coil drives the first diaphragm to vibrate to produce sound. The first diaphragm is fixedly connected to the connector, and the mounting member is fixed to the connector through the bending portion. With the structure, the first diaphragm is fixedly connected to the mounting member, so as to strengthen the overall strength of the speaker and prevent the deformation of the speaker in its vibrating direction, thereby improving the quality of the speaker.

REFERENCE SIGNS

Figure 1:
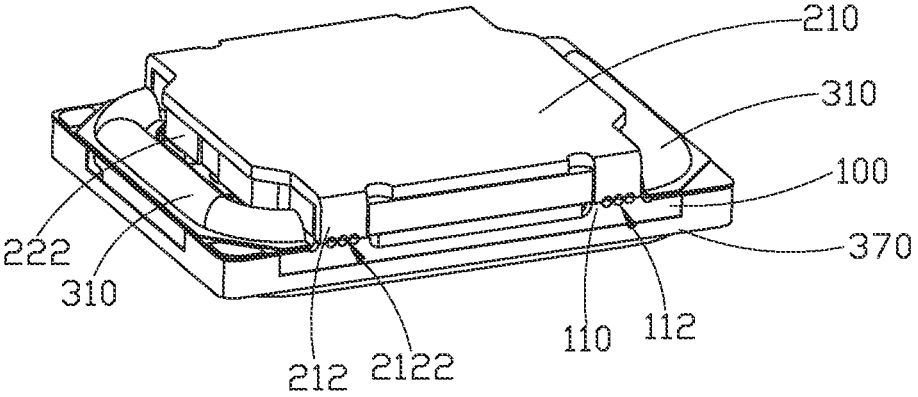
FIG. 1 is a schematic diagram of a three-dimensional structure of a speaker according to an embodiment.

10: spacing;

100: connector, 110: boss, 112: second notch;

200: magnetic circuit unit, 210: mounting member, 212: bending portion, 2122: first notch, 220: magnet assembly, 222: auxiliary magnet, 224: main magnet, 226: main pole plate,

228: auxiliary pole plate;

300: vibration system, 310: second diaphragm, 320: FPC board, 330: balancing member, 340: voice coil, 350: holder, 360: dome, 370: first diaphragm.

DESCRIPTION OF EMBODIMENTS

The technical solutions in embodiments of the present disclosure will be described clearly and completely below with reference to the accompanying drawings in the embodiments of the present disclosure. It is appreciated that, the described embodiments are merely some of rather than all of the embodiments of the present disclosure. All other embodiments acquired by those skilled in the art without creative efforts based on the embodiments of the present disclosure shall fall within the protection scope of the present disclosure.

It is to be noted that all directional indications (such as top, bottom, left, right, front, rear . . . ) in the embodiments of the present disclosure are merely to illustrate a relative position relation, a relative motion condition, etc. between parts in a certain particular state (as shown in the drawings). If the particular state changes, the directional indication changes accordingly.

In addition, the terms such as "first" and "second" in the present disclosure are used for descriptive purposes only, which cannot be construed as indicating or implying a relative importance or implicitly specifying the number of the indicated technical features. Thus, the features defined with "first" and "second" may explicitly or implicitly include at least one of the features. In addition, technical solutions of the embodiments of the present disclosure may be combined with each other. However, this must be based on the fact that those of ordinary skill in the art can implement the combination. When the combination of the technical solutions is contradictory or cannot be implemented, it should be considered that the combination of the technical solutions does not exist and does not fall within the protection scope claimed in the present disclosure.

Referring to FIG. 1 to FIG. 5, an embodiment of the present disclosure provides a speaker, including a connector 100 and a magnetic circuit unit 200 and a vibration system 300 that are fixed to the connector 100. The vibration system 300 includes a first diaphragm 370 fixed to the connector 100 and a voice coil 340 driving the first diaphragm 370 to vibrate and sound. The magnetic circuit unit 200 includes a magnet assembly 220 providing the voice coil 340 with driving force, and a mounting member 210 fixing the magnet assembly 220. A bending portion 212 is formed by bending from an edge of the mounting member 210 toward the first diaphragm 370, and the bending portion 212 is fixedly connected to the connector 100.

With the speaker provided above, the magnet assembly 220 is fixed to the mounting member 210, the magnet assembly 220 provides the voice coil 340 with driving force, the voice coil 340 vibrates back and forth under the action of the driving force, and the voice coil 340 drives the first diaphragm 370 to vibrate to produce sound. The first diaphragm 370 is fixedly connected to the connector 100. The mounting member 210 is connected to the connector 100 through the bending portion 212. With the structure, the first diaphragm 370 is fixedly connected to the mounting member 210, so as to strengthen the overall strength of the speaker and prevent the deformation of the speaker in its vibrating direction, thereby improving the quality of the speaker.

Figure 2:
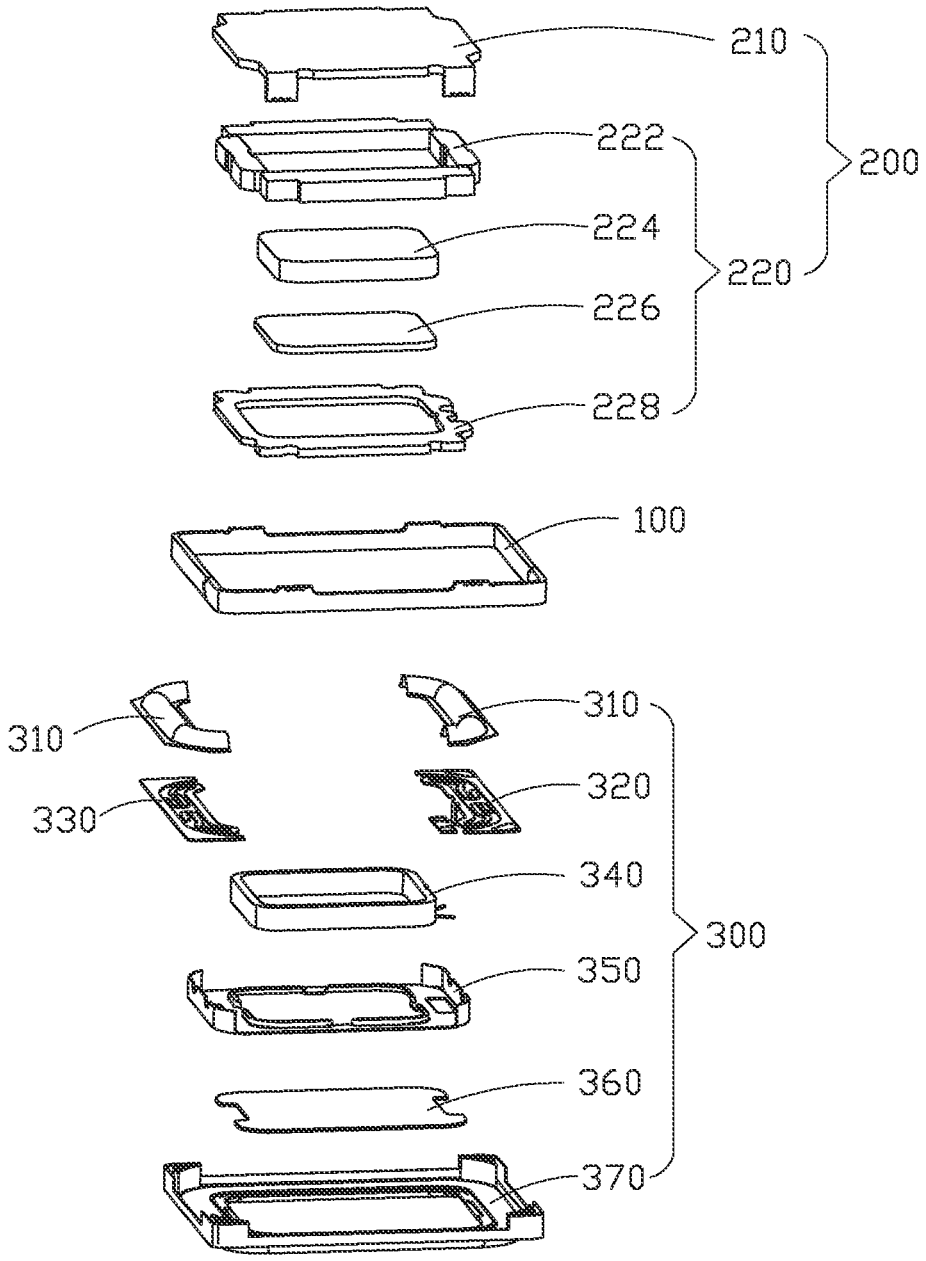
FIG. 2 is a schematic exploded view of the speaker as shown in FIG. 1.
Figure 3:
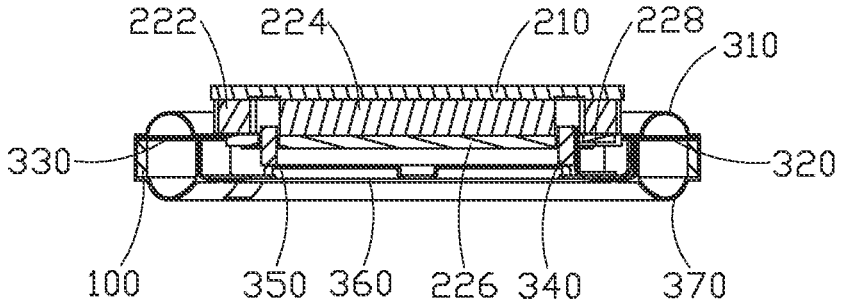
FIG. 3 is a sectional view of the speaker as shown in FIG. 1.
Figure 4:
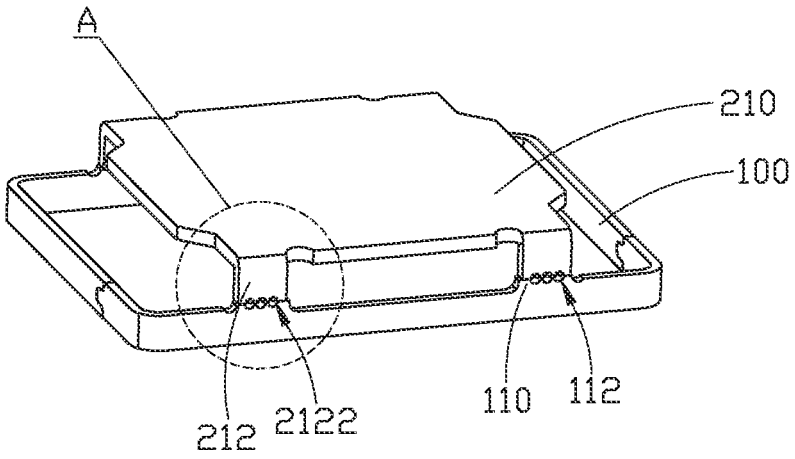
FIG. 4 is a schematic diagram of assembly between a mounting member and a connector of the speaker as shown in FIG. 1.
Figure 5:
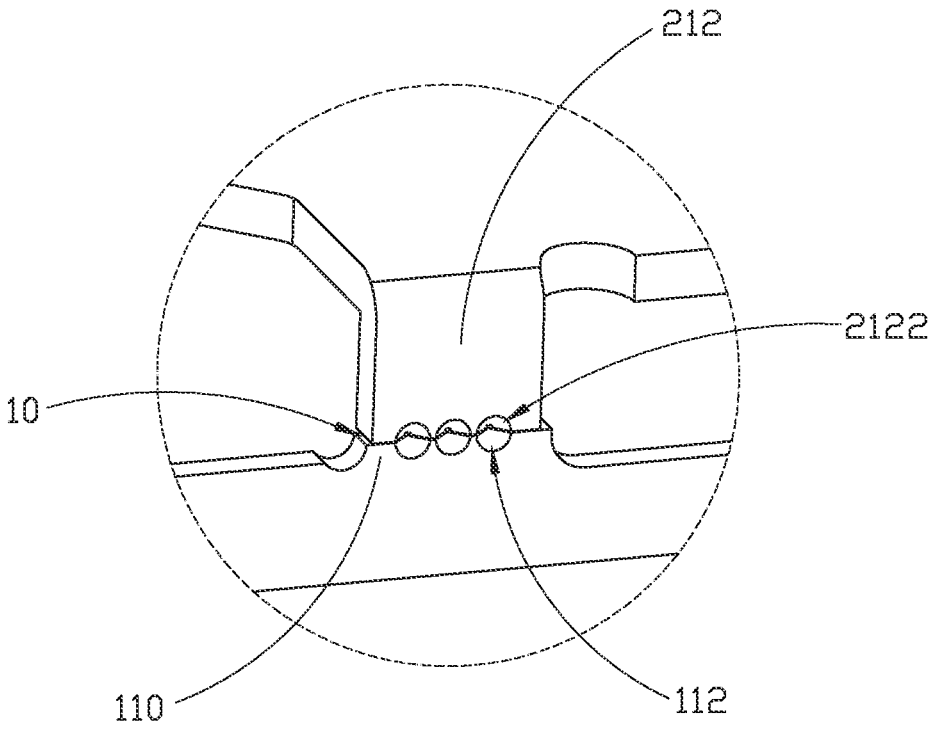
FIG. 5 is a schematic enlarged view of a part A between the mounting member and the connector as shown in FIG. 4.

In an embodiment, referring to FIG. 2 or FIG. 3, the magnet assembly 220 includes a main magnet 224, a plurality of auxiliary magnets 222 around an outer circumference of the main magnet 224, a main pole plate 226 directly opposite the main magnet 224 and configured to increase magnetic field strength, and an auxiliary pole plate 228 directly opposite the auxiliary magnet 222 and configured to increase the magnetic field strength. A magnetic gap is provided between the main magnet 224 and the auxiliary magnet 222.

In an embodiment, still referring to FIG. 2 or FIG. 3, the vibration system 300 includes a voice coil 340 movable in a gap, an FPC board 320, a balancing member 330, a holder 350 and a dome 360 arranged in the middle of the holder 350 and directly opposite to the voice coil 340. Two ends on one side of the voice coil 340 are elastically connected to the balancing member 330 and the FPC board 320, respectively. The other side of the voice coil 340 is connected to the holder 350, and the holder 350 is connected to the first diaphragm 370. The voice coil 340 vibrates to drive the first diaphragm 370 to vibrate.

In addition, the speaker further includes two second diaphragms 310. The two second diaphragms 310 are elastically connected to the balancing member 330 and the FPC board, respectively. The second diaphragm 310 vibrates with the vibration of the voice coil 340, and the second diaphragm 310 has functions of preventing dirt and dust.

In an embodiment, the bending portion 212 is fixed to the connector 100 by soldering.

In an embodiment, one end of the bending portion 212 close to the connector 100 is provided with a first notch 2122, one end of the connector 100 close to the bending portion 212 is provided with a second notch 112, and the first notch 2122 and the second notch 112 are enclosed to form a solder opening for soldering.

In addition, it is to be added that laser soldering may act on the solder opening.

In an embodiment, the connector 100 protrudes toward the mounting member 210 to form a boss 110, and the second notch 112 is located on the boss 110. The use of the boss 110 may relatively reduce a length of the bending portion 212 and further improve the strength of the bending portion 212.

Further, a spacing 10 exists between the bending portion 212 and the boss 110. It may be understood that a solder device propagates a large amount of heat during soldering, and the mounting member 210 and the connector 100 are prone to deformation or expansion when being heated. The spacing 10 between the bending portion 212 and the boss 110 provide a space for the deformation, thereby improving the overall appearance of a flanging connection structure.

Further, the mounting member 210 is fastened to the connector 100 and the first diaphragm 370 to form a receiving cavity configured to receive the magnet assembly 220 and the voice coil 340. The solder opening extends from exterior of the speaker to the receiving cavity. The structure facilitates an operator to solder the mounting member 210 and the connector 100, thereby further improving the efficiency of soldering.

Moreover, a sidewall of the bending portion 212 away from the receiving cavity is flush with a sidewall of the boss 110 away from the receiving cavity. This may help to improve the strength of soldering.

In an embodiment, the solder opening is in a tapered shape. The first notch 2122 and the second notch 112 are halves of the tapered shape, respectively. Optionally, the solder opening is in a cone shape. The structure facilitates full filling of the solder opening with solder fluid, thereby improving the quality of soldering.

Further, in order to better fix the connector 100 better arranged in a ring to the mounting member 210, a plurality of bending portions 212 are provided. The plurality of bending portions 212 are distributed on two sides of the mounting member 210, and the connector 100 is provided with the boss 110 having a same number as and in one-to-one correspondence to the bending portions 212.

Any of the bending portions 212 is provided with a plurality of first notches 2122. The boss 110 corresponding to the bending portion 212 is provided with a plurality of second notches 112 having a same number as and in one-to-one correspondence to the first notches 2122.

In an embodiment, the connector 100 is arranged in a ring shape, and the connector 100 extends toward the mounting member 210.

The above are only embodiments of the present disclosure. It should be pointed out that those of ordinary skill in the art may also make improvements without departing from the ideas of the present disclosure, all of which fall within the protection scope of the present disclosure.

What is claimed is:

1. A speaker, comprising: a connector and a magnetic circuit unit and a vibration system that are fixed to the connector, the vibration system comprising a first diaphragm fixed to the connector and a voice coil driving the first diaphragm to vibrate and sound, the magnetic circuit unit comprising a magnet assembly providing a driving force to the voice coil and a mounting member fixing the magnet assembly;

wherein a bending portion is formed by bending from an edge of the mounting member toward the first diaphragm, and the bending portion is fixedly connected to the connector, the bending portion is fixed to the connector by soldering, one end of the bending portion close to the connector is provided with a first notch, one end of the connector close to the bending portion is provided with a second notch, and the first notch and the second notch are enclosed to form a solder opening for soldering.

2. The speaker as described in claim 1, wherein the connector protrudes toward the bending portion to form a boss, and the second notch is located on the boss.

3. The speaker as described in claim 2, wherein a spacing is provided between the bending portion and the boss.

4. The speaker as described in claim 2, wherein the mounting member, the connector and the first diaphragm are enclosed to form a receiving cavity configured to receive the magnet assembly and the voice coil; and the solder opening extends from exterior of the speaker to the receiving cavity.

5. The speaker as described in claim 4, wherein a sidewall of the bending portion away from the receiving cavity is flush with a sidewall of the boss away from the receiving cavity.

6. The speaker as described in claim 1, wherein the solder opening has a tapered shape.

7. The speaker as described in claim 2, wherein a plurality of bending portions are provided and distributed on two sides of the mounting member, and the connector is provided with a plurality of bosses having a same number as and in one-to-one correspondence to the plurality of bending portions.

8. The speaker as described in claim 7, wherein each bending portion of the plurality of bending portions is provided with a plurality of first notches, and each boss of the plurality of bosses corresponding to the bending portion is provided with a plurality of second notches having a same number as and in one-to-one correspondence to the plurality of first notches.

* * * * *